United States Patent [19]

Patsaros

[11] 3,979,883

[45] Sept. 14, 1976

[54] CONTAINER LID MOUNTING DEVICE

[75] Inventor: Constantine A. Patsaros, Godfrey, Ill.

[73] Assignees: Bruce R. Schoeneweis, Alton; Robert H. Schoeneweis, Wood River, both of Ill. ; part interest to each

[22] Filed: June 5, 1975

[21] Appl. No.: 584,038

[52] U.S. Cl. ..... 53/306; 53/344

[51] Int. Cl.[2] ..... B65B 7/28

[58] Field of Search ..... 53/287, 306, 290, 297, 53/329, 341, 344, 374, 378

[56] References Cited

UNITED STATES PATENTS

| | | | |
|---|---|---|---|
| 2,173,122 | 9/1939 | Mancuso | 53/344 X |
| 2,241,711 | 5/1941 | Lowey | 53/344 |
| 3,634,995 | 1/1972 | Curtis | 53/306 X |
| 3,688,466 | 9/1972 | Geyer | 53/287 X |
| 3,792,567 | 2/1974 | Balcome | 53/329 |
| 3,896,607 | 7/1975 | Royal | 53/287 |

*Primary Examiner*—Travis S. McGehee
*Assistant Examiner*—Horace M. Culver
*Attorney, Agent, or Firm*—Ralph W. Kalish

[57] ABSTRACT

A device for mounting an independently formed closure upon an open-topped container wherein the container is stabilized by contents to constitute a stationary die, and with a forming die provided above said container for reciprocal movement toward and away from same. Said forming die contains a flat under surface for directing a flat closure upon the open upper end of said container and retaining same against inadvertent displacement; there being roller elements carried on said forming die for travel beneath the normally lower end thereof to direct marginal portions of the closure against said container and to hold same in such position to permit previously applied adhesive material to set.

6 Claims, 7 Drawing Figures

CONTAINER LID MOUNTING DEVICE

BACKGROUND AND SUMMARY OF THE INVENTION

This invention relates in general to packaging and, more particularly, to a device for mounting independently formed lids or closures upon containers.

Heretofore various efforts have been undertaken for effecting the closing of containers, as of cardboard and like material, which have been previously filled with particular ingredients. However, such containers have consistently been of the type wherein the closure is integrally formed with the container and thus a mere folding operation is required to secured the closure in container-closed condition. Thus, with such prior art structures the closure has been a flap developed from and integral with the container. It has been discovered that such closure-flap provided containers are not suitable for facile filling with many types of products as full access to the container interior has presented severe difficulties.

Therefore, it is an object of the present invention to provide a device which is adapted to present an independently formed closure or lid to a previously filled container and to conduce to the secure affixation of the closure or lid thereon.

It is another object of the present invention to provide a device of the character stated which is extremely versatile in usage being adapted for integration with assembly line operations and, hence, be readily incorporable in existing equipment without requiring costly modification thereof.

It is a further object of the present invention to provide a device of the character stated which incorporates minimum components, and wherein the container, as in filled condition, serves as a component of the device.

It is a still further object of the present invention to provide a device of the character stated which is readily adapted for automatic operation as by any suitable conventional drive means and which is, hence, capable of operating at predetermined rates as may be communsurate with a particular operation so that the same does not impede or restrict the designed volume flow of the related equipment.

It is a still further object of the present invention to provide a device of the character stated which may be most economically manufactured; which through its unique construction is resistant to breakdown; and which is extremely durable and reliable in usage.

DESCRIPTION OF THE PREFERRED EMBODIMENT

Figure 1:
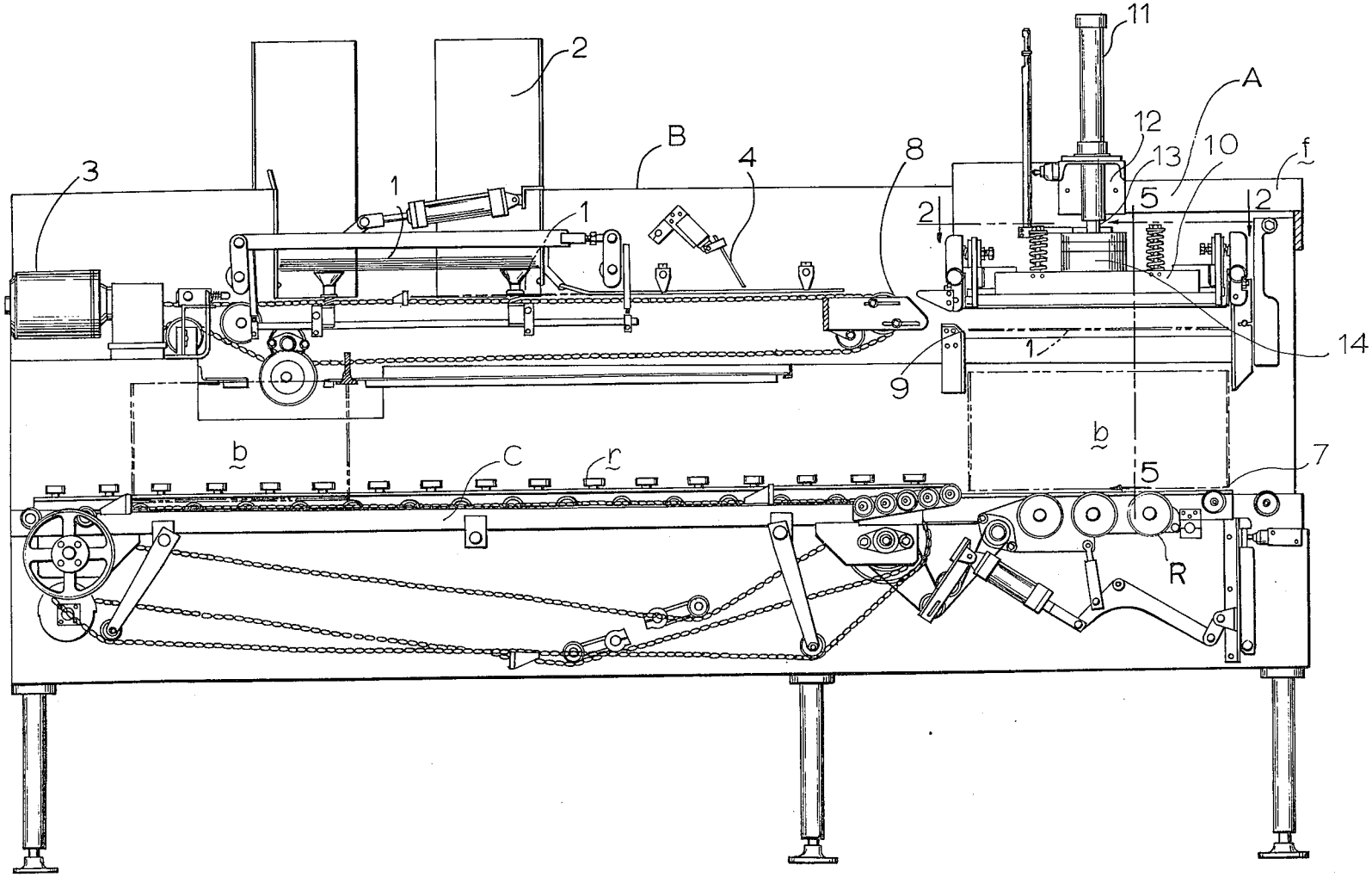
FIG. 1 is a partial elevational side view of a container filling machine incorporating a container lid mounting device constructed in accordance with and embodying the present invention.

Referring now by reference characters to the drawings which illustrate the preferred embodiment of the present invention, A generally designates a container lid mounting device which, for purposes of illustration only, is shown at the discharge end of a machine B. The said machine B does not form a part of the present invention but is shown to the extent necessary to provide an example of the environment in which the present invention may be used. Such machine is exemplary for such purpose and the components thereof will be described only to the extent to assist in a more ready comprehension of the operation of the present invention.

Machine B is thus of the type for receiving upon a conveyor, as indicated at C, an open top container or box *b* which has been previously supplied with the ingredients to be packed therein, such as, for instance, meat, chicken, hardware items etc. The said filled boxes are introduced to the conveyor C for movement toward the discharge end of the machine B as suggested at the right side of FIG. 1. There may be provided a multiplicity of the usual guide rollers *r* along conveyor C for assuring of proper linear travel of the container *b*. Upwardly of conveyor C, there may be provided a hopper or other retaining device 2 for receiving a supply of superimposed flat blanks 1 for ultimately constituting the closure or lids for container *b*. Electromechanical means, as broadly indicated at 3, are provided for delivering the bottom-most blank 1 from hopper 2 for direction forwardly to an adhesive applicator, as at 4, adapted to cost the marginal under face portions of said blanks with a suitable cementitious material. Although not shown in FIG. 1, said blanks being of quadrilateral character for conformity to container *b;* will have an area greater than the cross section of the particular container *b;* and with there being the usual scoring as at *s* inwardly of each marginal section 5, as is more clearly evident in FIG. 5. The cementitious coating being indicated at 6 in said Figure.

The individual containers *b* are conducted by conveyor C to a support 7 at the forward end of machine B for stationary disposition thereon with the latter thus being comparable to a bolster or other die support as may be found in conventional punch presses. Contemporaneously with the arrival of container *b* upon support 7 a closure blank 1 is delivered as through a passage 8 for flatwise presentation upon ledges, shoulders, or other comparable support means 9 immediately beneath a forming die, broadly indicated 10. As will be developed more fully hereinbelow said forming die 10 is depressed at a predetermined interval for carrying the closure blank 1 downwardly from its support for disposition coveringly across the open upper end of the below disposed container *b*. Continued operation of said forming die 10 will cause the blank marginal portions 5 to be folded downwardly along their adjacent scored lines so as to force the erswhile cementitious coated under face against the confronting marginal portions of container *b* and thereby held thereagainst to assure positive adherence. Upon the completion of this operation the forming die 10 is withdrawn upwardly, and in timed sequence the now fully closed container *b* is discharged from machine B. Suitable operational means are provided for effecting operative, depressing movement of forming die 10 and upward withdrawing action of same within a predetermined period provided at the appropriate juncture within the operation of machine B. Such means may comprehend circuitry involving microswitches, etc., but such do not constitute a part of the present invention which resides in part in the novelty of utilizing a container to be covered as a stationary die for cooperation with a movable die. It is, of course, understood that reciprocal vertical travel or stroke of forming die 10 may be effected by any well known means, such as pneumatic, hydraulic, electro-mechanical and, if need be, by manually operated mechanical expedients. However, for purposes of disclosure, forming die 10 is shown as being operated by a hydraulic unit indicated broadly 11 comprising a vertically presented cylinder 12 as maintained in position by suitable frame elements suggested at *f* and with there being a piston 13 projecting from the lower end of said cylinder 12 and carrying at its lower end an enlarged cylindrical head 14 for affixation on its underface to a platen 15. Said platen 15 is rigid, being formed of metal, and being horizontally presented in planar parallel relationship to container support or bolster 7. As may best be seen in FIG. 1, forming die 10 in upper position will be disposed above the discharge end of passage 8 so that the closure blanks 1 may be presented immediately below, but slightly downwardly of, forming die 10. Platen 15 is received within an upwardly opening guide receptacle or pan 16, which may be formed of suitable material, such as stainless steel, having a bottom wall 17 and a pair of upstanding side and end flanges 18, 18' and 19, 19', respectively, and with said upstanding flanges being cut away in their corner portions, as at 20, for clearance purposes, as the extremities of the corner portions of said platen, indicated at 15', project therethrough. Said receptacle 16 is adapted upon the lowering or operative stroke of forming die 10 to engage on the under face of its bottom wall 17 the confronting surface of the underlying closure blank 1 and with the length and width of said bottom wall 17 being substantially coincidental with that of the blank 1 within its scored lines *s*. Extending transversely of guide receptacle 16 between the upper end portions of side flanges 18, 18' is a pair of mounting bars 21, 21' fixed at their ends as by welding, screws, or otherwise, to the upper portions of said side flanges 18, 18'; said bars 21, 21' being axially parallel and spaced apart endwise of machine B on either side of cylindrical head 14 (see FIG. 2). Adjacent each of their ends said bars 21, 21' are drilled for extension therethrough of bolts 22, the lower ends of which, indicated at 23, are threadedly engaged within drilled and tapped apertures 24 formed in platen 15 and with there being a nut 25 for determining the extent of such threaded engagement. The major portion of the stem 26 of each bolt 22 is smooth surfaced and is encircled by a compression spring 27, the lower end of which bears against a relatively thin annular plate 28 seated upon the upper surface of the related bar 21 or 21', as the case may be; the upper end of spring 27 bears against a similar annular plate 29 which latter is restrained in position by a nut 30 engaged upon the upper threaded end 31 of bolt 22. The openings within bars 21, 21' are of sufficient diameter relative to that of the associated bolt 22 to permit relative movement of the latter therethrough so that platen 15 is relatively movable vertically within said guide receptacle 16. Compression springs 27 thus normally urge platen 15 into upwardly spaced relationship to the base wall 17 of guide receptacle 16 (see FIGS. 5 and 6) wherein said springs will be extended and, hence, substantially unstressed.

Mounted upon the upper face of platen 15 on each side and end thereof is a pair of mounting arms 32, 32' having aligned portions, as at 33, 33', respectively, which extend beyond the adjacent platen edge for rockably supporting pivot arms 34, 34', respectively, which latter at their lower ends support the end portions of a forming roller 35, the longitudinal axis of which is parallel to the adjacent platen edge.

Figure 2:
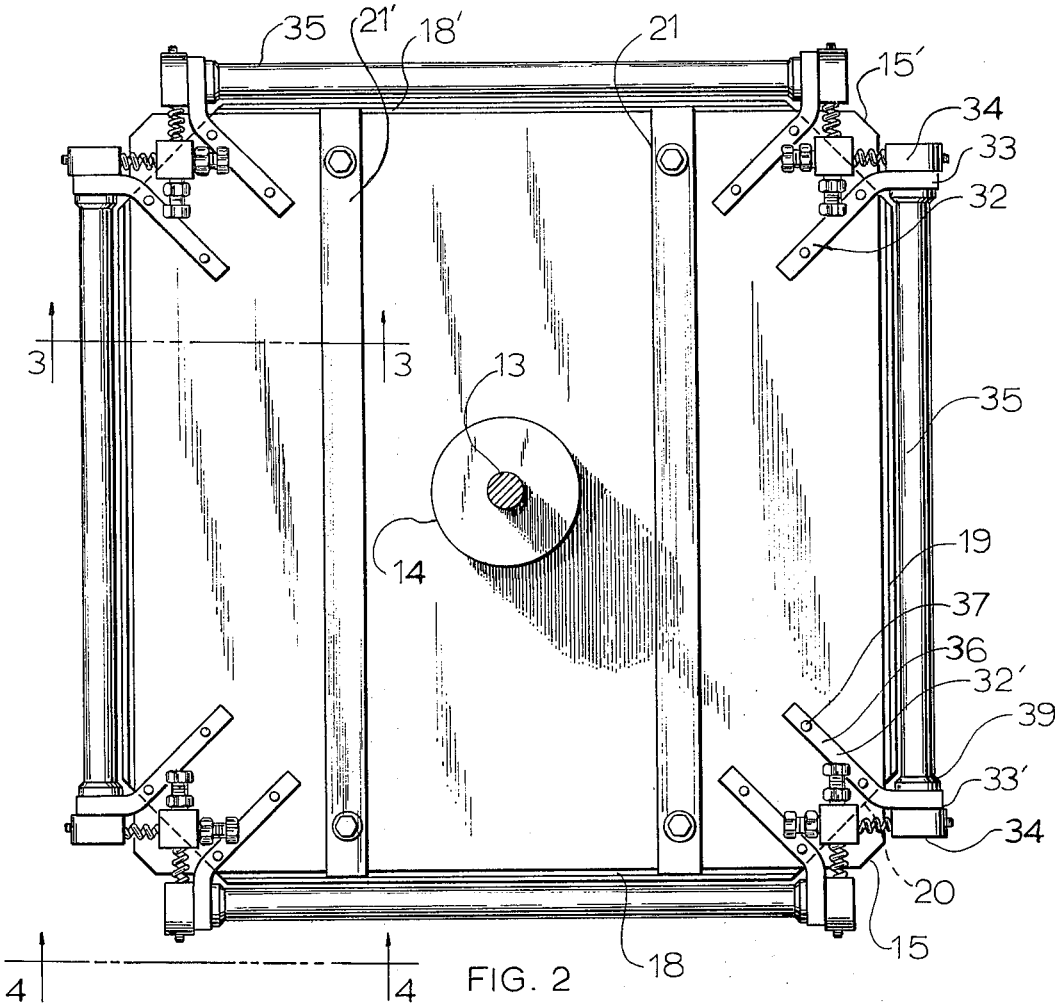
FIG. 2 is a top plan view taken on the line 2—2 of FIG. 1.
Figure 3:
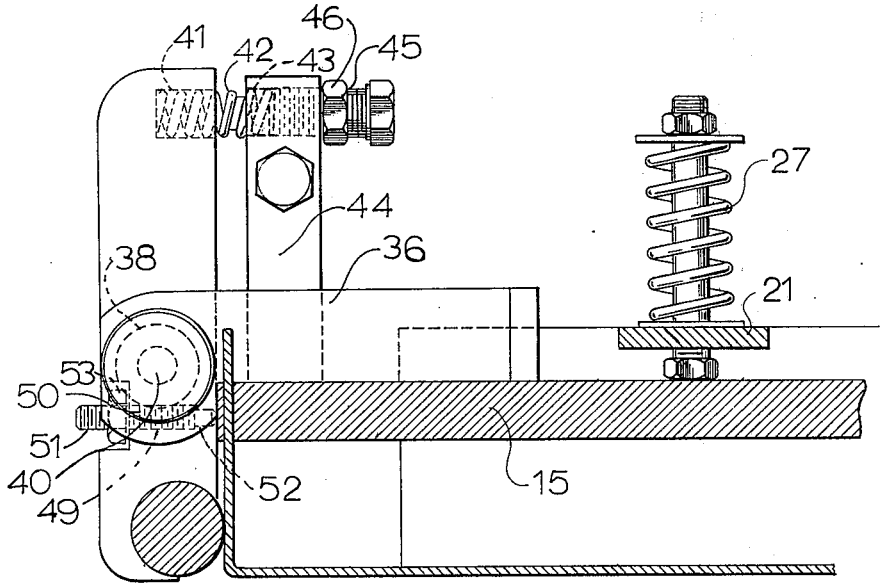
FIG. 3 is a vertical transverse sectional view taken on the line 3—3 of FIG. 2.
Figure 4:
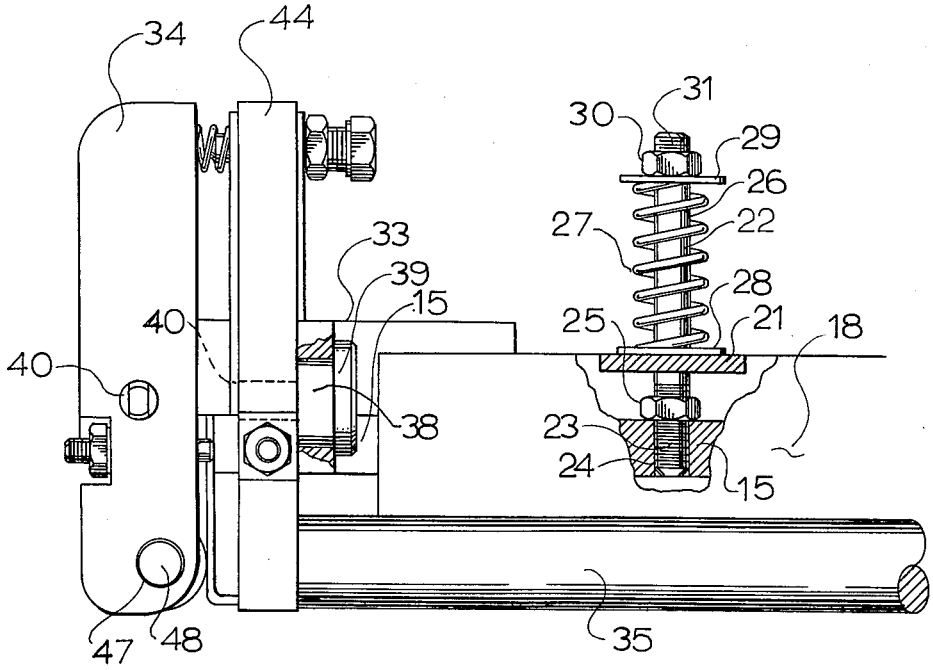
FIG. 4 is a vertical partial end view taken on the line 4—4 of FIG. 2, illustrating the forming die only.

Since the structure associated with each forming roller 35, there being four of the same, is identical only one such structure will be described in more detail for clarification. Thus, as may best be seen in FIGS. 2 and 3, companion mounting arms 32, 32' each incorporate a major or inner portion 36 axially at an angle of less than 90° to the associated edge of platen 15 and being affixed to the latter in any suitable manner, such as by screws, indicated at 37. The aforesaid portions 33, 33' of said mounting arms 32, 32' constitute the outer portions thereof and are angulated with respect to the related major portion 36 so that the planes thereof will be substantially normal to the adjacent platen edge; said outer portions 33, 33' as above stated, being presented laterally outwardly, but immediately proximate to, the adjacent platen edge. Each mounting arm outer portion 33, 33' is bored to provide a bearing 38 (see FIG. 3) for the enlarged head 39 of a pivot pin 40 secured within the proximate pivot arms 34, 34', as the case may be, the longitudinal axis of which is normally perpendicular to the plane of the adjacent outer portion of the proximate mounting arm 32, 32', as the case may be, and with the pivot pin connection being in the lower central zone of such arm 34, 34' (see FIG. 4). By virtue of the engagement of pivot arms 34, 34' upon mounting arms 32, 32', the former are adapted for swinging within a vertical plane about the axis of pivot pins 40. On the inner or platen-directed face of each pivot arm 34, 34' at its upper end there opens a relatively shallow recess 41 for receiving one end of a compression spring 42, the other end of which is accepted within a transverse bore 43 provided in an upstanding mounting block 44 rigid at its lower end upon platen 15. Bore 43 is tapped for receiving an adjustment screw 45 the inner end of which bears against the proximate end of spring 42 so that by suitable manipulation of said screw 45 the desired tension of spring 42 may be maintained. A nut 46 is engaged about screw 45 for assuring of maintenance of same in desired spring-controlling position. Thus, spring 42 urges the related pivot are 34, 34', as the case may be, outwardly or, otherwise, tends to resist any inward rocking of such end about its pivot.

Each of said pivot arms in their lower end portions are provided with bearings 47 for journalling therein of the diametrally reduced ends 48 of forming rollers 35.

Each pivot arm 34, 34' beneath its respective pivot pin 40 is bored and tapped, as at 49, and counterbored as at 50, for receiving a roller adjusting screw 51, the axis of which is normal to the longitudinal axis of the related pivot arm 34, 34' with said screw 51 having a reduced inner terminal portion, indicated at 52, for abutment against the proximate edge of platen 15; there being a locking nut 53 accepted within counterbore 50 for securing screw 51 in selected position. It will thus be seen that the inner end of screw 52 serves actually as a stop for inhibiting the swinging of the related pivot arm 34, 34' in order to effectively control the pressure applied by the respective rollers 35 during closure or lid securement.

Figure 5:
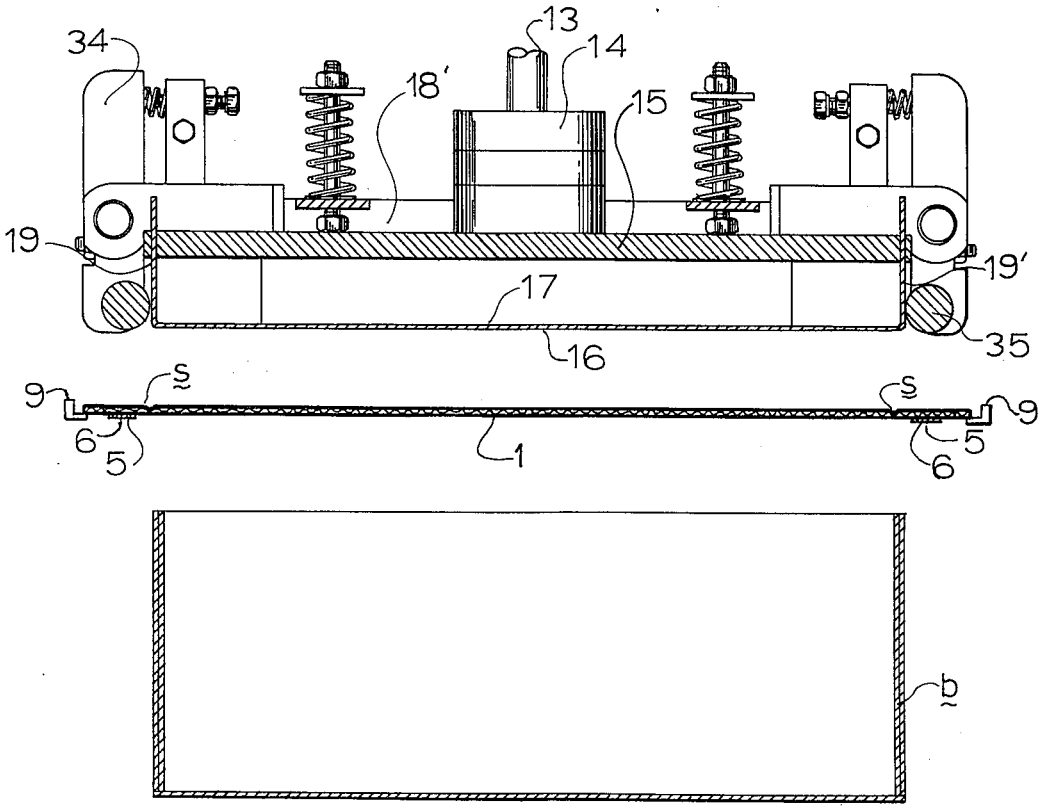
FIG. 5 is a vertical transverse sectional view taken on the line 5—5 of FIG. 1 illustrating the forming die in fully elevated, inoperative condition, illustrating the forming die only.
Figure 6:
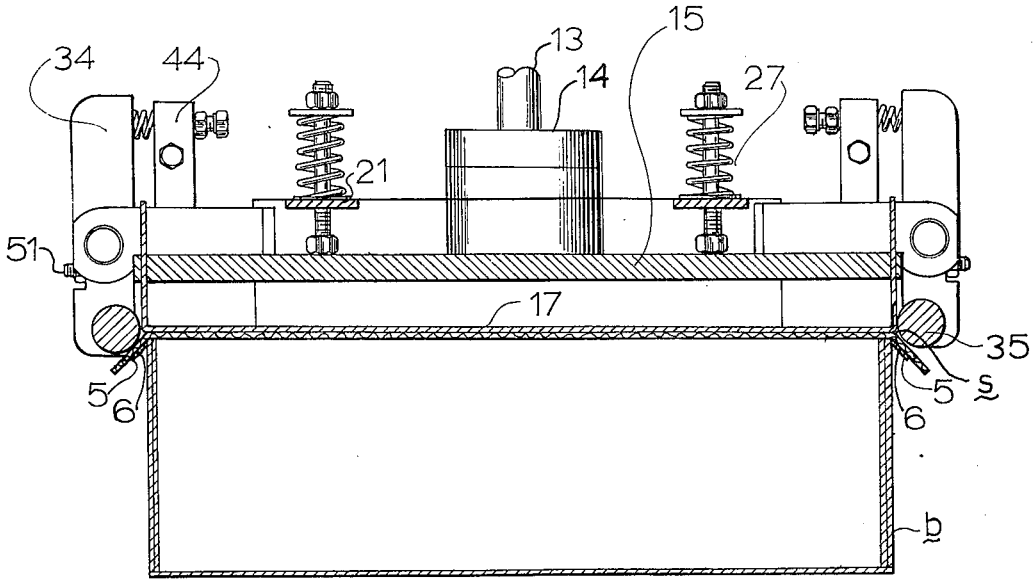
FIG. 6 is a vertical transverse sectional view taken substantially on the line 5—5 of FIG. 1 illustrating the forming die in partially depressed condition.
Figure 7:
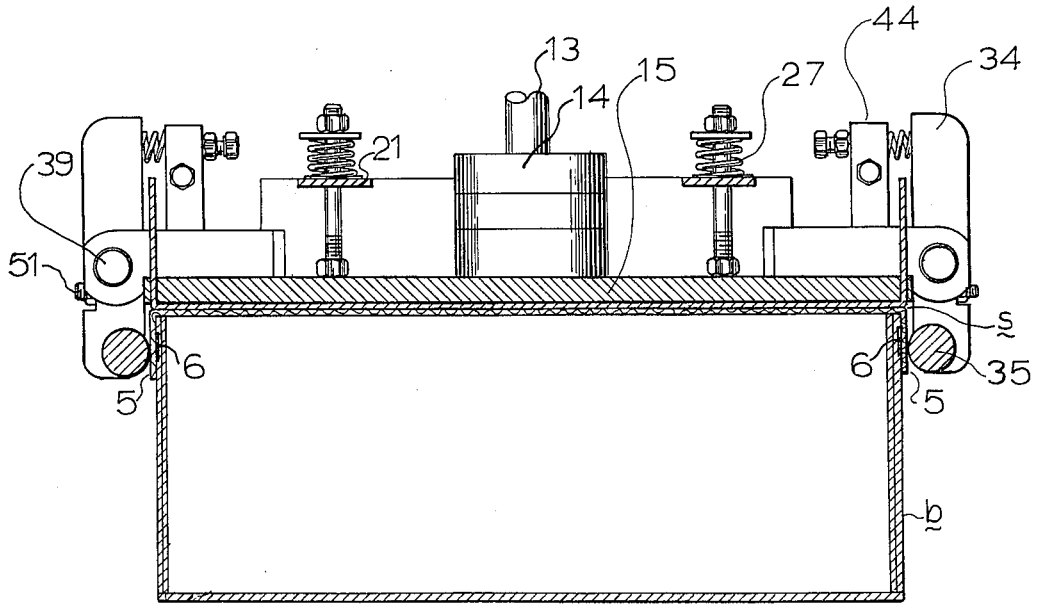
FIG. 7 is a vertical transverse sectional view taken substantially on the line 5—5 of FIG. 1 but illustrating the forming die in fully depressed, operative condition.

From the foregoing the operation of forming die 10 should be readily apparent but with reference now being made to FIGS. 5, 6, and 7, the operational sequence will become all the more clear.

As shown in FIG. 5, with forming die 10 in upper position, as indicated in FIG. 1, the particular container b, previously filled with the particular ingredients, is positioned immediately therebelow and the lid blank 1 to be secured is presented between forming die 10 and container *b* as by means of the supports above discussed. It will be observed that platen 15 is in elevated relation with respect to the base or bottom wall 17 of guide receptacle 16 and with forming rollers 35 abutting on their inner faces against the adjacent peripheral flange of guide receptacle 16 and presented in vertically spaced but overlying relationship to a marginal section 5 of blank 1, the under face of which has been previously provided with an adhesive, as at 6. By reference to FIG. 5 the dimensional relationships between forming die 10, lid blank 1, and container *b* is obvious; with forming rollers 35 being accordingly presented outwardly of the underlying side of container *b*.

The operative movement of forming die 10 is effected as by any suitable source of energy above discussed with the initial portion of the downward travel retaining the components in relative position, that is, with platen 15 located spacedly above bottom wall 17 of guide receptacle 16 and with the under face of bottom wall 17 engaging lid 1 and forcing same from its support and downwardly upon the upper open end of container *b*. As pointed out, container *b* has been previously filled with the intended material so that the same forms a stable unit constituting a stationary die as lid 1 is brought down thereupon the travel of forming die 10 is terminated. However, since the energy, as from a hydraulic cylinder, is still operating upon platen 15 the latter continues its relative travel downwardly into abutment upon the upper face of guide receptacle bottom wall 17 with springs 27 being thereby stressed (see FIG. 7). As said platen 15 thus travels downwardly it will carry with it the forming rollers 35 thereby bringing same into forceful contact with lid marginal sections 5 and cause said marginal sections to be bent downwardly along scored lines *s* and brought forcefully against the confronting side faces of container *b* (see FIGS. 6 and 7). The dwell of forming die 10 is of sufficient duration to assure that lid marginal sections 5 are held against container *b* by rollers 35 until the cementitious material or adhesive, as at 6, has caused a positive securement between said lid and container *b*. It will, of course, be noted that the appropriate adjustment of springs 42 and screws 51 insure requisite force being applied by rollers 35 so at to both bend lid marginal sections 5 and retain same against displacement until adhesion is completed. It will, of course, be seen that by the relative movement of platen 15 with respect to guide receptacle 16 rollers 35 are disposed for operation and the distance of the same below guide receptacle 16 may be determined by the extent of the particular lid marginal sections 5.

Upon termination of the lid-securing operation, forming die 10 is elevated as by any suitable means and the now fully closed container *b* is ejected from machine B as by any suitable means, such as, for instance, by elevation of erstwhile depressed rollers, as at R.

In view of the foregoing certain of the unusual features of the present invention should be observed. Guide receptacle 16 if relatively heavy, as being formed of stainless steel so that it would have a reasonably strong gravitational pull resisting the compression of springs 27. This weight factor thus reduces the amount of force required by the particular platen drive means whether such be pneumatic, hydraulic, or the like. Also by this weight relationship, when forming die 10 commences its upward or retracting movement, said receptacle 16 will be gravitationally urged into lowered position with reference to platen 15. Guide receptacle 16 thus serves to firmly maintain lid 1 in covered position upon container *b* during the forming operation and to assist in compressing the contents of container *b* against any upward bulging above the upper edge thereof; while simultaneously supporting the lid 1 against rupture or deformation by such contents.

The inherent bias of springs 42 will tend to urge the associated forming rollers 35 inwardly so that when the same have cleared guide receptacle 16 they will cause requisite force for directing the marginal portions 5 of lid 1 into snug abutment against container *b*.

As may be evident from the foregoing, lids 1 are lightly held by support means 9 so that when forming die 10 moves downwardly it will cause said lids 1 to be deflected slightly upwardly in their marginal portions along scored portions *s* for clearing the said support 9.

I claim;

1. A device for mounting independently formed lids upon containers comprising means supporting a normally open top container in stationary position, means presenting a lid for closurewise disposition upon said container open top in elevated relationship thereto, a forming die provided above said lid, means effecting vertical reciprocal travel of said forming die toward and away from said container, whereby upon downward travel of said die said lid is moved into closurewise disposition upon said container open top with said container serving as a stationary die, said forming die comprising a platen guide having a flat bottom surface engageable with said lid upon downward travel of said forming die directing same onto said container, said platen guide having upstanding flanges from the marginal portions of said bottom surface, means interengaging upper portions of opposed flanges of said platen guide, a platen disposed within said platen guide beneath said flange interengaging means, resilient means interconnecting said platen and said means interengaging said flanges whereby said platen guide is urged downwardly of said platen, and forming members carried upon said platen for travel therewith, said forming members being disposed outwardly of said platen guide engaging marginal portions of said lid.

2. A device as defined in claim 1 and further characterized by said means for effecting vertical reciprocal travel of said die comprising means connected directly to said platen whereby upon termination of downward travel of said platen guide, said platen will continue its travel against the bias of said resilient means into disposition upon said platen guide flat bottom.

3. A device as defined in claim 1 and further characterized by said lid being of greater area than said container open top and being scored spacedly from its edges to define foldable marginal portions, said forming die flat bottom surface being of substantially similar dimensions as said lid within the area bounded by said lid scores, said forming members engaging the marginal portions of said lid outwardly of said scores effecting bending of the same from the plane of said lid.

4. A device as defined in claim 3 and further characterized by said means engaging said lid marginal portions being elongated rollers.

5. A device as defined in claim 4 and further characterized by spaced apart support arms fixed upon said platen extending beyond the margins thereof and outwardly beyond the adjacent guide flanges, pivot arms swingably mounted upon said support arms for rockable movement within a vertical plane, said elongated rollers being carried at the lower ends of said pivot arms.

6. A device as defined in claim 5 and further characterized by said platen being quadrilateral, a roller presented outwardly of each side of said platen, resilient means urging said pivot arms laterally outwardly at their upper ends thereby biasing said rollers inwardly.

* * * * *